US007740152B2

(12) United States Patent
Hughes et al.

(10) Patent No.: US 7,740,152 B2
(45) Date of Patent: Jun. 22, 2010

(54) PUMP SYSTEM WITH CALIBRATION CURVE

(75) Inventors: Robert Hughes, Atlanta, GA (US); Gregg Carpenter, Marietta, GA (US); Lawrence B. Ziesel, Woodstock, GA (US); David R. Newman, Atlanta, GA (US); Russell H. Beavis, Merrimack, NH (US)

(73) Assignee: The Coca-Cola Company, Atlanta, GA (US)

( * ) Notice: Subject to any disclaimer, the term of this patent is extended or adjusted under 35 U.S.C. 154(b) by 868 days.

(21) Appl. No.: 11/276,548

(22) Filed: Mar. 6, 2006

(65) Prior Publication Data

US 2007/0207040 A1 Sep. 6, 2007

(51) Int. Cl.
*B67D 7/74* (2010.01)

(52) U.S. Cl. ..... 222/129.1; 222/1; 222/129.4; 222/132; 222/136; 700/231; 700/254

(58) Field of Classification Search ..... 222/129.1, 222/129.3, 143, 56, 129.2, 129.4, 130, 132, 222/136, 1; 700/231, 239, 240, 241, 242, 700/254; 134/18, 57; 415/1
See application file for complete search history.

(56) References Cited

U.S. PATENT DOCUMENTS 4,779,761 A 10/1988 Rudick et al.
4,981,024 A * 1/1991 Beldham ..... 68/12.18
5,014,211 A * 5/1991 Turner et al. ..... 700/239
5,114,047 A * 5/1992 Baron et al. ..... 222/129.1
5,134,962 A * 8/1992 Amada et al. ..... 118/688
5,145,339 A * 9/1992 Lehrke et al. ..... 417/521
5,240,380 A 8/1993 Mabe
5,305,915 A * 4/1994 Kamysz et al. ..... 222/63
5,457,626 A * 10/1995 Wolze ..... 700/32
5,615,801 A 4/1997 Schroeder et al.
5,673,820 A * 10/1997 Green et al. ..... 222/129.3
5,829,636 A * 11/1998 Vuong et al. ..... 222/63
5,842,603 A * 12/1998 Schroeder et al. ..... 222/23
5,947,692 A 9/1999 Sahlin et al.
5,971,714 A * 10/1999 Schaffer et al. ..... 417/44.2
5,996,650 A 12/1999 Phallen et al.
6,186,193 B1 2/2001 Phallen et al.
6,435,375 B2 8/2002 Durham et al.
6,464,464 B2 10/2002 Sabini et al.
6,685,054 B2 2/2004 Kameyama
6,756,069 B2 6/2004 Scoville et al.
6,994,231 B2 2/2006 Jones (Continued)

FOREIGN PATENT DOCUMENTS

EP 0105017 A2 9/1983

(Continued)

*Primary Examiner*—Frederick C. Nicolas
(74) *Attorney, Agent, or Firm*—Sutherland Asbill & Brennan LLP

(57) ABSTRACT

A pumping system for pumping one out of a number of fluids with varying viscosities. The pumping system may include a positive displacement pump and a control for operating the positive displacement pump. The control may include viscosity compensation data. The viscosity compensation data relates to at least one of the fluids such that the control instructs the positive displacement pump to operate based on the viscosity of the fluid.

20 Claims, 2 Drawing Sheets

U.S. PATENT DOCUMENTS

| | | | | |
|---|---|---|---|---|
| 7,108,024 | B2 | 9/2006 | Navarro | |
| 7,108,156 | B2 | 9/2006 | Fox | |
| 7,156,115 | B2 | 1/2007 | Everett et al. | |
| 7,156,259 | B2 | 1/2007 | Bethuy et al. | |
| 7,159,743 | B2 | 1/2007 | Brandt et al. | |
| 7,162,391 | B2 | 1/2007 | Knepler et al. | |
| 7,164,966 | B2 | 1/2007 | Sudolcan | |
| 7,243,818 | B2 * | 7/2007 | Jones | 222/129.1 |
| 7,299,944 | B2 | 11/2007 | Roady et al. | |
| 7,356,381 | B2 * | 4/2008 | Crisp, III | 700/242 |
| 7,559,346 | B2 * | 7/2009 | Herrick et al. | 141/105 |
| 2001/0041139 | A1 | 11/2001 | Sabini et al. | |
| 2003/0091443 | A1 * | 5/2003 | Sabini et al. | 417/53 |
| 2003/0116177 | A1 * | 6/2003 | Appel et al. | 134/18 |
| 2004/0084475 | A1 * | 5/2004 | Bethuy et al. | 222/1 |
| 2005/0103799 | A1 | 5/2005 | Litterst et al. | |
| 2005/0166761 | A1 | 8/2005 | Jones et al. | |
| 2005/0166766 | A1 | 8/2005 | Jones et al. | |
| 2005/0269360 | A1 | 12/2005 | Piatnik et al. | |
| 2006/0043101 | A1 * | 3/2006 | Bhimani et al. | 222/1 |
| 2006/0054614 | A1 | 3/2006 | Baxter et al. | |
| 2006/0081653 | A1 | 4/2006 | Bolland et al. | |
| 2006/0172056 | A1 | 8/2006 | Tobin et al. | |
| 2006/0174778 | A1 | 8/2006 | Greiwe | |
| 2006/0180610 | A1 | 8/2006 | Haskayne | |
| 2006/0213928 | A1 | 9/2006 | Ufheil et al. | |
| 2006/0237556 | A1 | 10/2006 | Wulteputte et al. | |
| 2006/0292012 | A1 | 12/2006 | Brudevold et al. | |
| 2007/0009365 | A1 | 1/2007 | Litterst et al. | |
| 2008/0029541 | A1 | 2/2008 | Wallace et al. | |

FOREIGN PATENT DOCUMENTS

| | | | |
|---|---|---|---|
| EP | 0112791 | A2 | 9/1983 |
| EP | 0154681 | A1 | 9/1984 |
| EP | 0810370 | A2 * | 5/1997 |
| EP | 0810370 | | 12/1997 |
| EP | 1356866 | | 10/2003 |
| EP | 1356866 | A2 * | 10/2003 |
| EP | 1690592 | | 2/2005 |
| EP | 1762138 | | 3/2007 |
| GB | 2416757 | | 2/2006 |
| GB | 2429694 | | 7/2007 |
| WO | 00/29103 | | 5/2000 |
| WO | 00/68136 | | 5/2000 |
| WO | 02066835 | A1 | 8/2002 |
| WO | 2005/068836 | | 7/2005 |
| WO | 2006/012916 | | 2/2006 |
| WO | 2006/070257 | | 7/2006 |
| WO | 2006/108606 | | 10/2006 |
| WO | 2007/002575 | | 1/2007 |

* cited by examiner

PUMP SYSTEM WITH CALIBRATION CURVE

TECHNICAL FIELD

The present application relates generally to pumping systems and more particularly relates to a positive displacement pump system using pump calibration curves.

BACKGROUND OF THE INVENTION

Generally described, a positive displacement pump delivers a fixed volume of liquid for each cycle of pump operation. The only factor that impacts the flow rate in an ideal positive displacement pump is pump speed. The flow characteristics of the overall system in which the pump operates should not impact the flow rate therethrough.

In practice, variations exist between the theoretical flow rate and the actual flow rate due primarily to influences from the volumetric efficiency of the pump, pump slippage (internal fluid bypass from the outlet to the inlet), system pressure, and fluid viscosity. Each individual pump could have different performance characteristics dependent on these and other variables.

Thus, there is a desire for a pump that can accommodate the different influences such as fluids of differing viscosities and volumetric efficiencies. Specifically, the pump system should accommodate different fluid characteristics and variations in the system itself.

SUMMARY OF THE INVENTION

The present application thus describes a pumping system for pumping one out of a number of fluids with varying viscosities. The pumping system may include a positive displacement pump and a control for operating the positive displacement pump. The control may include viscosity compensation data. The viscosity compensation data relates to at least one of the fluids such that the control instructs the positive displacement pump to operate based on the viscosity of the fluid.

The pumping system further may include a number of fluid containers for the number of fluids. The fluid containers may include an identifier positioned thereon. The identifier may include a radio frequency identification tag. The pumping system further may include a fluid source identification device capable of reading the identifier.

The viscosity compensation data may include data relating to a pump output at a given flow. The viscosity compensation data may include a number of viscosity compensation charts. The viscosity compensation data may include volumetric efficiency data on the positive displacement pump.

The present application further describes a method for operating a positive displacement pump with one out of a number of fluids with varying viscosities. The method may include determining the slippage rate of the positive displacement pump for each of the number of different fluids at a given flow rate, determining the compensation rate for each of the number of different fluids, placing one of the number of fluids in communication with the pump, and pumping the one of the number of fluids at the given flow rate based upon the compensation rate.

The step of pumping the fluids at the given flow rate based upon the compensation rate may include varying the number or rate of strokes, cycles, steps, or pulse width modulation of the positive displacement pump. The step also may include increasing the speed of the positive displacement pump or increasing the length of time the positive displacement pump operates. The step of determining the compensation rate for each of the different fluids may include volumetric efficiency data on the positive displacement pump.

The present application further may describe a beverage dispenser. The beverage dispenser may include a number of fluid sources with a number of fluids of different viscosities, a dispensing valve, a positive displacement pump to pump one of the fluids from the fluid sources to the dispensing valve, and a control for operating the positive displacement pump in response to the dispensing valve. The control may include compensation data related to the number of fluids such that the positive displacement pump compensates for the viscosity of the fluids during operation.

The compensation data may include a number of viscosity compensation charts. The compensation data may include volumetric efficiency data on the positive displacement pump such that the positive displacement pump compensates for the volumetric efficiency of the positive displacement pump.

The fluid sources may include a number of fluid containers. The fluid containers may include an identifier positioned thereon. The identifier may include a radio frequency identification tag. The beverage dispenser may include a fluid source identification device capable of reading the identifier.

These and other features of the present application will become apparent to one of ordinary skill in the art upon review of the following detailed description when taken in conjunction with the drawings and the appended claims.

DETAILED DESCRIPTION

Figure 1:
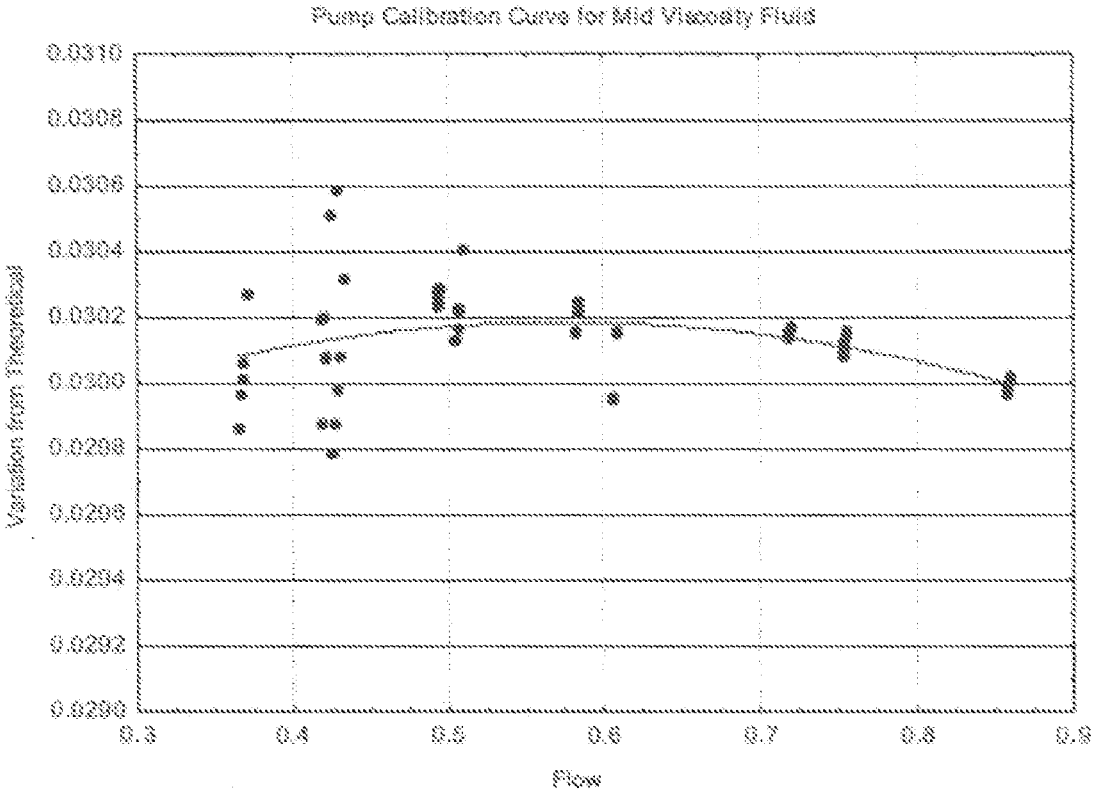
FIG. 1 is a pump displacement calibration chart.
Figure 2:
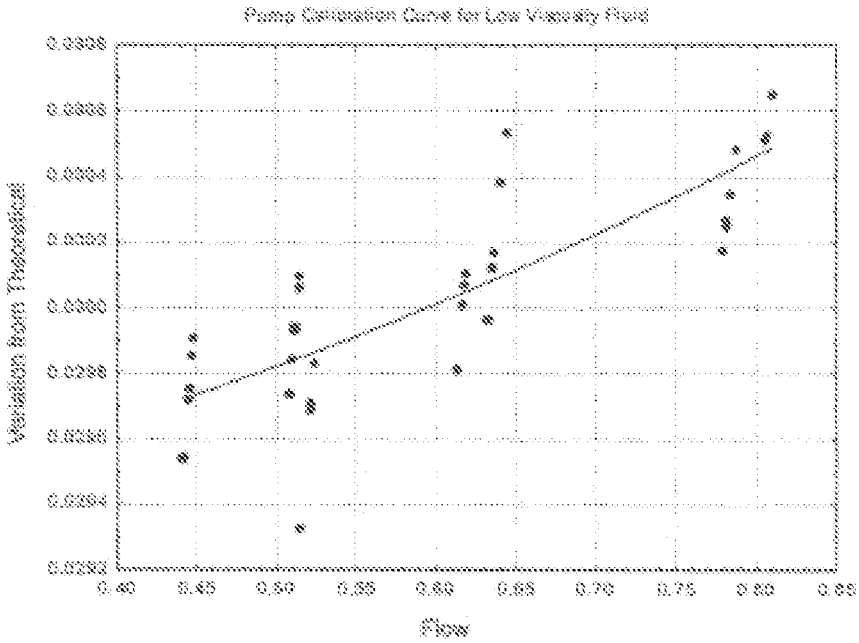
FIG. 2 is an alternative pump displacement calibration chart.

Referring now to the drawings, in which like numerals indicate like elements throughout the several views, FIG. 1 shows a calibration chart 10 for a positive displacement pump 100 as is described herein. As above, an ideal pump would have a fixed displacement regardless of the system influences. In practice, however, the displacement can vary across the flow range due to system variables. One reason for the variation in pump displacement is the viscosity of the fluid. For example, FIG. 1 shows the variation chart 10 for a mid-viscosity fluid such as syrup. FIG. 2, on the other hand, shows a slippage chart 20 for a less viscous fluid similar to water in viscosity. As is shown, the use of this fluid results in more variation. Know pumps 100 can be calibrated to account for the variation, but this calibration generally is only accurate for a given fluid at a given condition. Many known pumps also may have manufacturer's tolerances of up to three percent (3%) or so.

Figure 3:
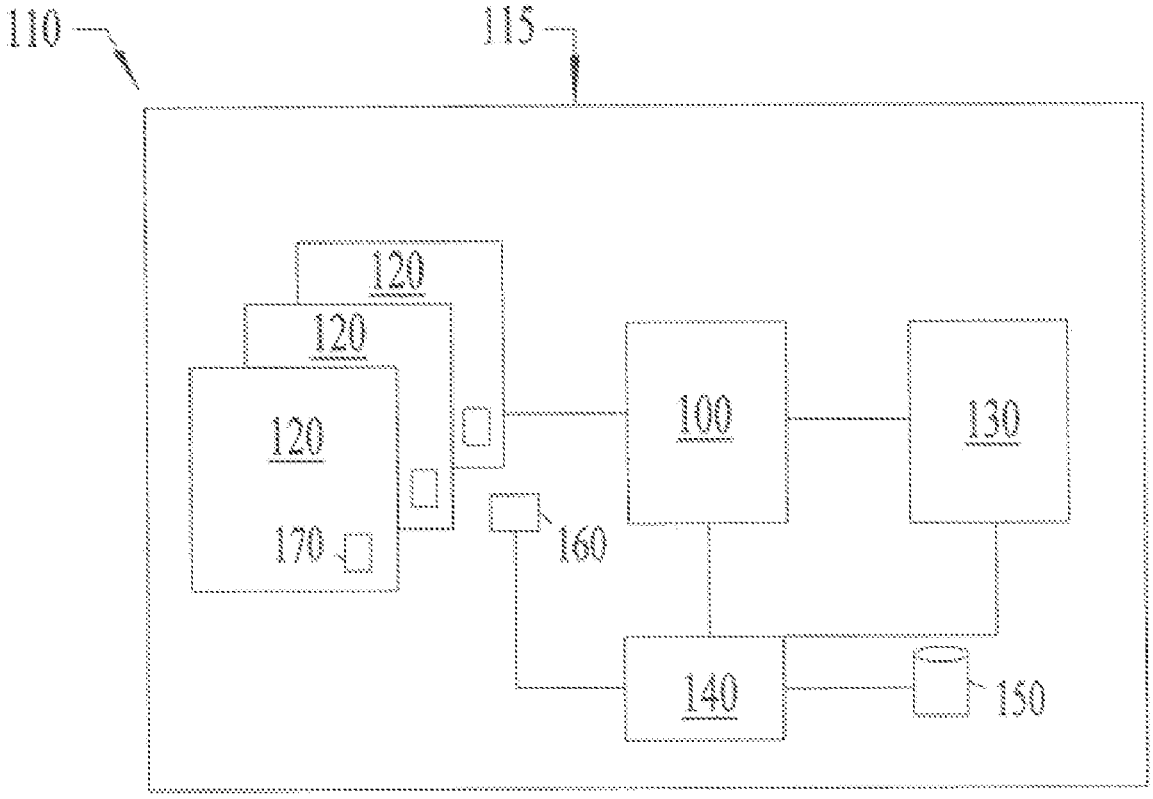
FIG. 3 is a schematic view of a pump system as is described herein.

FIG. 3 shows a pump system 110. In this example, the pump system 110 may be a beverage dispenser 115 although any type of pumping application may be used herein. The beverage dispenser 115 may accommodate different types of fluids with different types of viscosities. For example, the beverage dispenser 115 thus may dispense carbonated soft drinks, sports beverages, juices, waters, coffees, teas, flavorings, additives, or any other type of fluid. Each of these fluids may have a different viscosity.

The pump 100 may be any type of positive displacement pump. For example, the pump 100 may be a solenoid pump, a gear pump, an annular pump, a peristaltic pump, a syringe pump, a piezo pump or any other type of positive displacement device that is intended to pump a fixed displacement for each pump cycle. The pump 100 may be operated in any conventional manner such as electric, pressure, or otherwise. For example, the pump 100 may include a DC motor that is operated via pulse width modulation, i.e., the motor (and hence the pump 100) operates at a higher speed given longer pulses. Other operating means such as a stepper motor operated by a given number of pulses also may be used. The pressure source for the pump 100 may be from a water supply or compressed gas. Any type of pump operating means may be used and accommodated herein.

The beverage dispenser system 115 may include a number of fluid sources 120 in communication with the pump 100. The fluid sources 120 may be conventional bag in box containers, conventional water connections, or any other type of fluid storage, supply, or delivery device. The pump 100 and the fluid sources 120 may be connected in any convenient low, slight negative, or non-pressurized manner. The beverage dispenser system 115 may have a selection device so as to select the desired fluid source.

The beverage dispenser system 115 further may include a dispensing valve 130 in communication with the pump 100. The dispensing valve 130 may be of conventional design. The dispensing valve 130 may dispense a given fluid or the valve 130 may mix a number of fluids to create, for example, a carbonated soft drink from syrup or concentrate and water. The pump 100 and the dispensing valve 130 may be connected in any convenient manner.

The beverage dispenser 115 further may include a control 140. The control 140 may be a conventional microprocessor or any other type of conventional control system. The control 140 may have a conventional memory 150 or other type of data storage device associated therewith. Alternatively, the memory 150 may be associated with the pump 100 in the form of FLASH memory or similar structures. The control 140 may be dedicated to the pump 100 or the control 140 may operate the beverage dispenser 115 as a whole. Specifically, the control 140 may be in communications with the pump 100 and the dispensing valve 130. The control 140 may be remotely based and/or may be commanded remotely to instruct the pump 100. Remote commands may be wireless and/or optical. The control 140 may be in communication with a network, continuously or intermittently, for the exchange and updating of information.

The control 140 also may be in communication with a fluid source identification device 160 positioned about the fluid source 120. For example, each fluid source 120 may have a radio frequency identification (RFID) tag 170 positioned thereon or a similar type of device. Likewise, any type of wireless communication protocols may be used. A bar code tag, a two-dimensional tag, or other types of visual identifiers may be used. Further, other identifies may include density/specific gravity, pH, etc. (The term tag 170 thus refers to all of these identifiers). The tag 170 identifies the nature of the fluid therein. The fluid source identification device 160 is capable of reading the tag 170 and informing the control 140 of the nature of the fluid. Alternatively, the control 140 may have other types of data input means so as to determine the nature of the fluid. The pump 100 and/or the control 140 also may have a set of switches, jumpers, or other types of electronic or optical identifiers.

A number of the calibration curves 10, 20 for the given pump 100 may be stored in the memory 150. The calibration curves 10, 20 accommodate the slippage and other factors of the individual pump 100 for a given fluid at a desired flow rate. The pump 100 may be calibrated over a number of different fluids with different viscosities.

In use, the dispensing valve 130, when activated, instructs the pump 100 to pump a fluid from the fluid source 120 at a predetermined flow rate. If the pump 100 is configured for an analog signal, the control 140 would interpret that signal, correlate the signal to a flow rate, calibrate the flow rate based upon the calibration curves 10, 20 for the given liquid, and command the pump 100 as appropriate. Likewise, if the dispensing valve 130 provides data pocket commands, then the control 140 would interpret that data packet, correlate the flow rate to the calibration curves 10, 20, and command the pump appropriately.

For example, if the dispensing valve 130 dispenses a beverage at a given flow rate, the control 140 would consider the calibration chart 10 for the given fluid. The control 140 thus would instruct the pump 100, for example, to increase its motor speed or other variable and hence provide additional pump cycles or instruct the pump 100 to operate for an additional amount of time. Specifically, for a fixed volume solenoid pump, the length of the on/off cycle may vary; for a stepper motor, the number of or rate of steps may vary; for a piezo pump, the cyclic profile may vary; and in a DC pump, the pump speed may vary. Other variations may be used. In any case, the correct volume of fluid will be dispensed.

As is shown in FIG. 1, the variation from the theoretical for a mid-viscosity fluid such as syrup increases from an inverse K-factor of about 0.0301 to about 0.0302 cc (cubic centimeter) per pulse (or stroke or other variable) as the flow rate increases from about 0.4 to about 0.6 cc per second and then decreases back to about 0.0300 cc per pulse as the flow rate continues past about 0.8 cc per second. In FIG. 2 by contrast, the variation for a low viscosity fluid increases steadily as the flow rate increases. As is shown, the variation increases from an inverse K-factor of about 0.0297 cc per pulse at a flow rate of about 0.045 cc per second to more than 0.0304 cc per pulse at about 0.80 cc per second. (The K-factor is an indication of volumetric throughput.) FIG. 1 is an example only. Different pumps and different fluids will have different curves.

Once determined, the calibration factors can be applied. For example, if the desired flow rate for a solenoid pump with a given fluid is 10 cc per second and a flow independent calibration factor is 0.1 cc per pump stroke, then the number of required stokes is 100, i.e., 10 cc/s divided by 0.1 cc/stroke. (The number of cycles, steps, or voltage also can be used.)

Likewise, the calibration factor may be flow dependent. For example, if the desired flow rate is again 10 cc per second and the fluid is a low viscosity fluid such as water may be 0.1 cc/stroke-0.001 s/stroke*flow (cc/s). The required number of strokes may be 111.1, i.e., 10 cc/s (0.1 cc/stroke-0.001 s/stroke*10 cc/s) or 10 cc/s/(0.09 cc/stroke). If the fluid is more viscous (about 25 to 50 centipoise), then the calibration factor may be 0.1 cc/stroke-0.005 s/stroke*flow (cc/s). The required number of strokes may be 200, i.e., 10 cc/s/(0.1 cc/stroke-0.005 s/stroke*10 cc/s) or 10 cc/s/(0.050 cc/stroke).

These examples are for the purposes of illustration only. Any number of other variables may be accommodated. For example, the charts may compensate for low pressure, slight negative, or non-pressurized sources or multiple sources connected to the same pump 100. The charts also may be created by visual observation of the amount of material delivered from a known fluid reservoir upon its displacement.

The beverage dispenser system 115, the pump 100, and the control 140 also may take into consideration temperature, leak detection, pressure, contamination detection, weighting devices, level sensors, clocks, other timing devices, age (shelf life), and any other operating parameter. For example, if the viscosity of a fluid was out of the calibration range, the system 115 could apply heating or cooling. The pump 100 also may pump non-liquid ingredients.

Related applications that are filed herewith may be applicable to the disclosure herein. U.S. patent application Ser. No. 11/276,553, entitled "Methods and Apparatuses for Making Compositions Comprising an Acid and an Acid Degradable Component and/or Compositions Comprising a Plurality of Selectable Components"; U.S. patent application Ser. No. 11/276,550, entitled "Beverage Dispensing System"; U.S. patent application Ser. No. 11/276,551, entitled "Dispensing Nozzle Assembly"; and U.S. patent application Ser. No. 11/276,549, entitled "Juice Dispensing System" are incorporated herein by reference.

It should be apparent that the foregoing relates only to the preferred embodiments of the present application and that numerous changes and modifications may be made herein without departing from the general spirit and scope of the invention as defined by the following claims and the equivalents thereof.

We claim:

1. A pumping system for pumping one out of a number of fluids with varying viscosities, comprising:

a positive displacement pump; and an open loop control for operating the positive displacement pump;

the control comprising viscosity compensation data;

wherein the viscosity compensation data relates to at least one of the number of fluids such that the control instructs the positive displacement pump to operate based on the viscosity of the one of the number of fluids and a volumetric efficiency of the positive displacement pump.

2. The pumping system of claim 1, further comprising a plurality of fluid containers for the number of fluids.

3. The pumping system of claim 2, wherein the plurality of fluid containers comprises an identifier positioned thereon.

4. The pumping system of claim 3, wherein the identifier comprises a radio frequency identification tag.

5. The pumping system of claim 3, further comprising a fluid source identification device capable of reading the identifier.

6. The pumping system of claim 1, wherein the viscosity compensation data comprises data relating to a pump output at a given flow.

7. The pumping system of claim 1, wherein the viscosity compensation data comprises a plurality of viscosity compensation charts.

8. The pumping system of claim 1, wherein the viscosity compensation data comprises volumetric efficiency data on the positive displacement pump.

9. A method for operating a positive displacement pump with one out of a number of fluids with varying viscosities, comprising:

determining a slippage rate of the positive displacement pump for each of the number of different fluids at a given flow rate;

determining a compensation rate for each of the number of different fluids;

storing the compensation rate for each of the number of different fluids in an open loop control;

placing one of the number of fluids in communication with the pump; and pumping the one of the number of fluids at the given flow rate based upon the compensation rate.

10. The method of claim 9, wherein the step of pumping the one of the number of fluids at the given flow rate based upon the compensation rate comprises varying a number or rate of strokes, cycles, steps, or a pulse width modulation of the positive displacement pump.

11. The method of claim 9, wherein the step of pumping the one of the number of fluids at the given flow rate based upon the compensation rate comprises increasing a speed of the positive displacement pump.

12. The method of claim 9, wherein the step of pumping the one of the number of fluids at the given flow rate based upon the compensation rate comprises increasing a length of time the positive displacement pump operates.

13. The method of claim 9, wherein the step of determining the compensation rate for each of the number of different fluids comprises volumetric efficiency data on the positive displacement pump.

14. A beverage dispenser, comprising:

a plurality of fluid sources with a plurality of fluids of different viscosities;

a dispensing valve;

a positive displacement pump to pump one of the plurality of fluids from the plurality of fluid sources to the dispensing valve; and an open loop control for operating the positive displacement pump in response to the dispensing valve;

wherein the control comprises compensation data related to the one of the plurality of fluids such that the positive displacement pump compensates for the viscosity of the one of the plurality of fluids and a volumetric efficiency of the positive displacement pump during operation.

15. The beverage dispenser of claim 14, wherein the compensation data comprises a plurality of viscosity compensation charts.

16. The beverage dispenser of claim 14, wherein the compensation data comprises volumetric efficiency data on the positive displacement pump.

17. The beverage dispenser of claim 14, wherein the plurality of fluid sources comprises a plurality of fluid containers.

18. The beverage dispenser of claim 17, wherein the plurality of fluid containers comprises an identifier positioned thereon.

19. The beverage dispenser of claim 18, wherein the identifier comprises a radio frequency identification tag.

20. The beverage dispenser of claim 18, further comprising a fluid source identification device capable of reading the identifier.

* * * * *